US005361219A

United States Patent [19]

Shou et al.

[11] Patent Number: 5,361,219

[45] Date of Patent: Nov. 1, 1994

[54] DATA CIRCUIT FOR MULTIPLYING DIGITAL DATA WITH ANALOG

[75] Inventors: Guoliang Shou; Weikang Yang; Sunao Takatori; Makoto Yamamoto, all of Tokyo, Japan

[73] Assignee: Yozan, Inc., Tokyo, Japan

[21] Appl. No.: 158,295

[22] Filed: Nov. 29, 1993

[30] Foreign Application Priority Data

Nov. 27, 1992 [JP] Japan ..... 4-341493

[51] Int. Cl.[5] ..... G06J 1/00

[52] U.S. Cl. ..... 364/606

[58] Field of Search ..... 364/606, 602

[56] References Cited

U.S. PATENT DOCUMENTS

| | | | |
|---|---|---|---|
| 4,422,155 | 12/1983 | Amir et al. | 364/606 |
| 4,458,324 | 7/1984 | Burke et al. | 364/606 |
| 4,470,126 | 9/1984 | Haque | 364/606 |
| 4,475,170 | 10/1984 | Haque | 364/606 |

OTHER PUBLICATIONS

Iwai, "The Beginning of Logical Circuit", The Electrical Engineering Handbook, 1980, pp. 144–146.

Miyazaki, "The Analog Usage Handbook", CQ Suppan kabushikigaisha, 1992, pp. 139–140.

"The Electrical Engineering Handbook", Richard C. Dorf, Editor-in-Chief, 1993, pp. 1861–1865.

*Primary Examiner*—Tan V. Mai

*Attorney, Agent, or Firm*—Cushman, Darby & Cushman

[57] ABSTRACT

A multiplication circuit for directly multiplying analog and digital data without converting the analog data into digital data or the digital data into analog data. The multiplication circuit controls an analog input voltage by the use of a switching signal of a digital voltage so as to generate an analog output or to cut-off the output. Digital input signals $b_0$ to $b_7$ corresponding to a plural number of bits are integrated and given corresponding weights by use of a capacitive coupling unit, and a sign bit is added by the capacitive coupling unit by giving the sign bit double the weight of the most significant bit of the digital input.

7 Claims, 2 Drawing Sheets

DATA CIRCUIT FOR MULTIPLYING DIGITAL DATA WITH ANALOG

BACKGROUND OF THE INVENTION

1. Field of the Invention

The present invention relates to a multiplication circuit.

2. Description of the Art

In recent years, there has been controversy over the limitations of digital computers due to the exponential increase in the amount of money invested in equipment relating to minute processing technology. Thus, analog computers are now receiving greater attention. On the other hand, conventional digital storage technology should be used and thus, both digital processing and analog processing which work together are necessary. However, conventionally, a circuit which directly operates on analog and digital data without using A/D and D/A converters has not been previously known.

SUMMARY OF THE INVENTION

The present invention solves the conventional problems noted above and provides multiplication of analog and digital data without converting the analog data into digital data or the digital data into analog data.

A multiplication circuit according to the present invention controls an analog input voltage by the switching signal of a digital voltage so as to generate an analog output or to cut-off the output. A digital input signal of a plural number of bits is integrated, given weight by means of capacitive coupling, and a sign bit is added by capacitive coupling with a double weight of the most significant bit of the digital input.

DETAILED DESCRIPTION OF THE PRESENTLY PREFERRED EXEMPLARY EMBODIMENTS

Hereinafter, an embodiment of a multiplication circuit according to the present invention is described with reference to the attached drawings.

Figure 1:
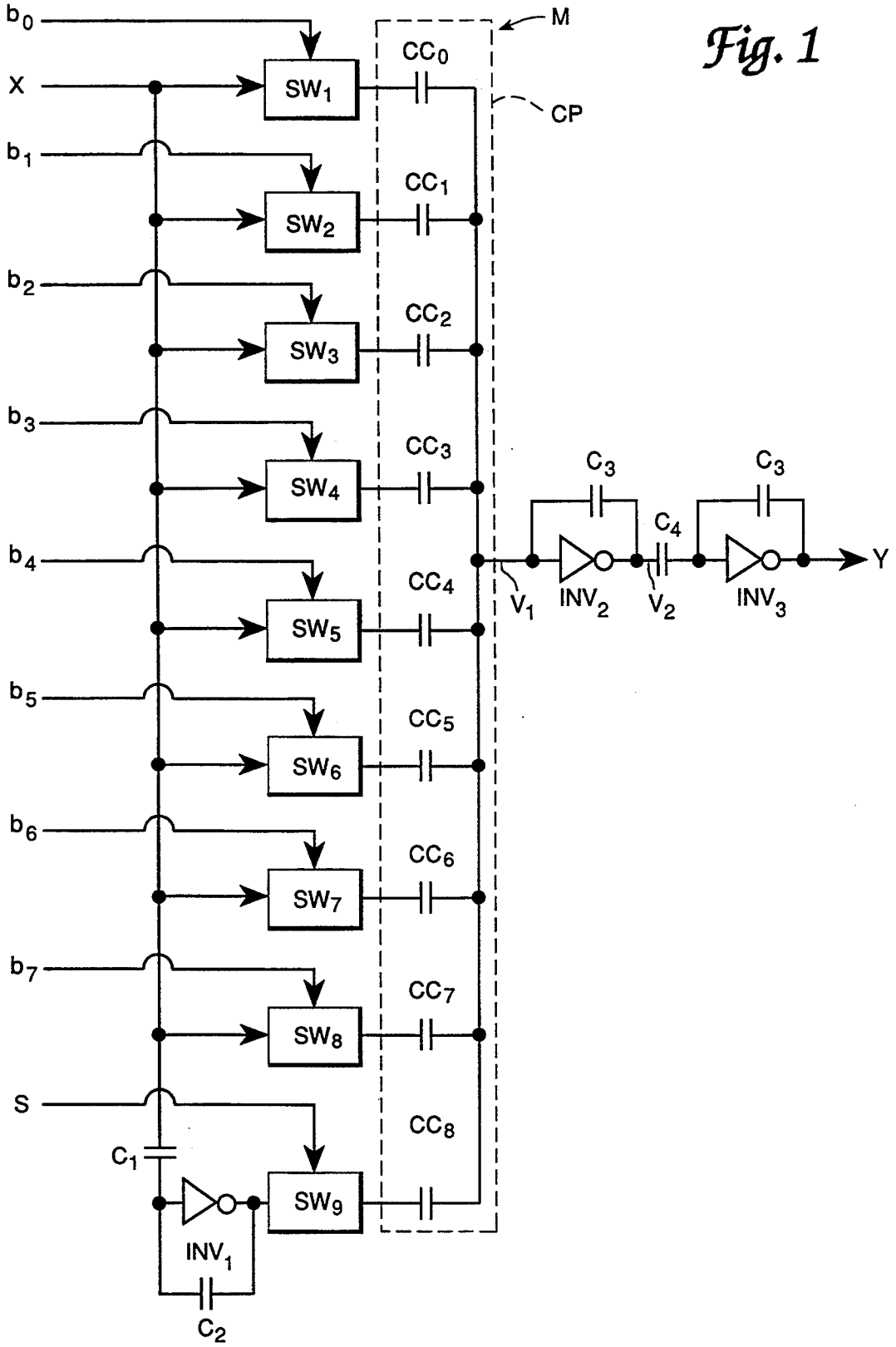
FIG. 1 is a circuit showing the first embodiment of a multiplication circuit according to the present invention.

In FIG. 1, a multiplication circuit M has a plural number of switching circuits from SW, to $SW_8$, each connected with a common analog input voltage X and digital input voltages from $b_0$ to $b_7$, which corresponds to each bit of digital data. Common analog input voltage X is used as a control signal for the switching circuits.

The outputs of the switching circuits are connected with a corresponding capacitance of a capacitive coupling unit CP. Capacitive coupling unit CP parallelly connects a plural number of capacitances $CC_0$ to $CC_7$, and the output of capacitive coupling unit CP outputs an output voltage Y through serial inverter circuits $INV_2$ and $INV_3$. The capacities of capacitances $CC_0$ to $CC_7$ are preselected to correspond to a weight to be given to $b_0$ to $b_7$, that is from $2^0$ to $2^7$. These capacitances are defined as follows when the unit capacity is $C^{(F)}$.

$$CC_0=2^0\times C^{(F)} \quad (1)$$

$$CC_1=2^1\times C^{(F)} \quad (2)$$

$$CC_2=2^2\times C^{(F)} \quad (3)$$

$$CC_3=2^3\times C^{(F)} \quad (4)$$

$$CC_4=2^4\times C^{(F)} \quad (5)$$

$$CC_5=2^5\times C^{(F)} \quad (6)$$

$$CC_6=2^6\times C^{(F)} \quad (7)$$

$$CC_7=2^7\times C^{(F)} \quad (8)$$

Thus, an analog input voltage X passing through each switching circuit SW, is multiplied by a weight proportional to $2^{i-1}$, wherein i is in the range from 1 to 8.

Capacitive coupling unit CP includes a capacitance $CC_8$. Capacitance $CC_8$ is connected to the analog input voltage X through a capacitance $C_1$, an inverter INV, and a switching circuit $SW_9$. A digital input voltages corresponding to a signa of the digital data is input to the $SW_9$. An output of $INV_1$ is fed back to an input side through a capacitance $C_2$ which has a capacity which is equal to the capacity of capacitance C1. Thus inverter circuit $INV_1$ accurately generates the voltage $-X$.

A capacity of a capacitance $CC_8$ is set as follows.

$$CC_8=2^8\times C(F) \quad (9)$$

By the switching of switching circuits $SW_1$ to $SW_8$, the following output at point $V_1$ in FIG. 1 is obtained.

$$V_1 = X\left\{\sum_{i=0}^{7}(2^i\times b_i) - 2^8 x^s\right\} \quad (10)$$

The output at $V_1$ is converted by an inverter circuit $INV_2$ with a feedback circuit including a capacitance $C_3$. The voltage at point $V_2$ in FIG. 1 is therefore described by the following formula.

$$V_2 = V_1\left(C_3/\sum_{i=0}^{8} CC_1\right) \quad (11)$$

If capacitance $C_3$ is selected as follows:

$$C_3 = \sum_{i=0}^{8} CC_1 \quad (12)$$

then:

$$V_2=-V_1 \quad (13)$$

Inverter circuit $INV_3$ is connected to an output of an inverter circuit $INV_2$ through a capacitance $C_4$, and feedback circuit including a capacitance $C_5$ is provided in $INV_3$.

Thus, inverter circuit $INV_3$ generates an output as shown in formula 14 when formula 12 is satisfied.

$$Y=-V_2(C_5/C_4)=V_1(C_5/C_4) \quad (14)$$

If $C_4$ is set to equal $C_5$ then:

$$Y = V_1 \quad (15)$$

As mentioned above, products of an analog input voltage X and a digital input voltage (from $b_0$ to $b_7$) are directly calculated by multiplication circuit M and it is possible to perform inverted or a non-inverted processing corresponding to sign bit −s.

Figure 2:
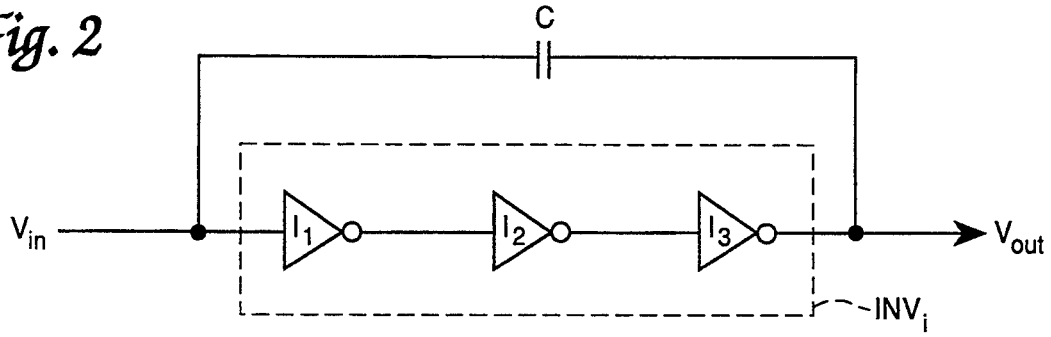
FIG. 2 is a detailed diagram showing an inverter circuit.
Figure 3:
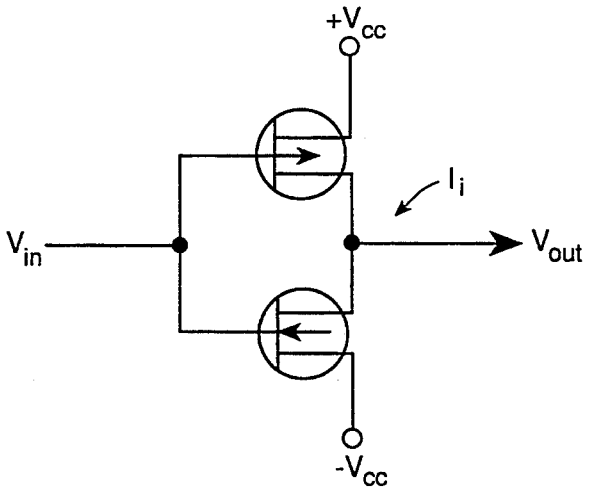
FIG. 3 is a circuit of an inverter.

FIG. 2 shows an inside composition of inverter circuit $INV_1$, which can be used in inverter circuits $INV_1$, $INV_2$ and $INV_3$. FIG. 3 shows an inverter $I_1$, which can be used for any of the inverters $I_1$, $I_2$ and $I_3$ which are shown in FIG. 2.

FIG. 2 shows that by serially connecting a plural number of inverters from $I_1$ to $I_3$, the output accuracy becomes higher. As shown in FIG. 3, inverters $I_1$ to $I_3$ consist of an nMOS and a pMOS, the drain of the pMOS is connected with a positive voltage, the source of the pMOS is connected with the drain of the nMOS, and the source of the nMOS is connected with a negative voltage. An input voltage is input to the gates of the nMOS and the pMOS. An output is generated from the source of the pMOS and the drain of the nMOS which are connected together.

Figure 4:
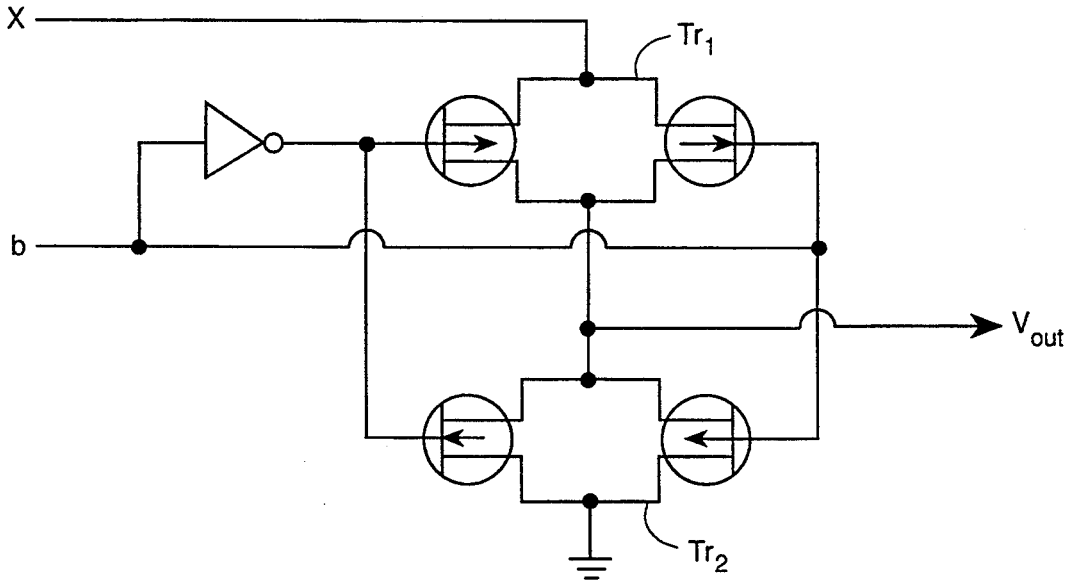
FIG. 4 is a circuit showing a switching circuit.

FIG. 4 shows a switching circuit in detail. The switching circuit is a CMOS switch consisting of a CMOS $Tr_1$ and dummy transistor $Tr_2$. An input voltage X is input to a drain of $Tr_1$, and an output is generated at the junction between $Tr_1$ and $Tr_2$. A digital input voltage b is invertedly connected to the gate of a pMOS of $Tr_1$ and the gate of an nMOS of $Tr_2$. Digital input voltage b is non-invertedly connected to the gate of an nMOS of $Tr_1$ and to the gate of a pMOS of $Tr_2$. Thus, when the switching circuit is conductive the output voltage $V_{out}$ will be the input voltage X.

As mentioned above, a multiplication circuit according to the present invention controls an analog input voltage by use of a switching signal of a digital voltage so as to generate an analog output or to cut-off the output. A digital input signal of a plural number of bits is integrated and given corresponding weights by use of a capacitive coupling unit, and a sign bit is added by a capacitive coupling with a double weight of the MSB of the digital input.

Thus, it is possible to provide a multiplication circuit which directly multiplies analog and digital data without converting the analog data into digital data or the digital data into analog data.

We claim:

1. A multiplication circuit comprising:

switching circuits, each for receiving analog data and a corresponding bit of digital data and for outputting said analog data in accordance with said corresponding bit of said digital data; and a capacitive coupling unit for outputting the multiplication of said analog data nd said digital data, said capacitive coupling unit having a plurality of first capacitances, said first capacitances being connected in parallel with each other, each first capacitance receiving a corresponding one of said outputs of said switching circuits, and each first capacitance having a capacity which is based upon a preselected weight to be given to said corresponding bit of said digital data.

2. A multiplication circuit according to claim 1, wherein each said switching circuit includes a CMOS transistor.

3. A multiplication circuit according to claim 1, wherein each said switching circuit includes a CMOS transistor and a dummy transistor.

4. A multiplication circuit according to claim 1, further comprising:

a first inverter, being connected to receive said output of said capacitive coupling unit, for inverting said output of said capacitive coupling unit;

a second capacitance, being connected to said first inverter, for receiving said inverted output of said capacitive coupling unit; and a second inverter, being connected to said second capacitance, for inverting said inverted output of said capacitive coupling unit, thereby reproducing said output of said capacitive coupling unit.

5. A multiplication circuit according to claim 4, further comprising:

a third capacitance, being connected to said first inverter so as to form a feed-back loop, having a capacity which is equal to the total capacity of said capacitive coupling unit.

6. A multiplication circuit according to claim 4, further comprising:

a fourth capacitance, being connected to said second inverter so as to form a feed-back loop, having a capacity which is equal to the capacity of said second capacitance.

7. A multiplication circuit comprising:

first switching circuits, each for receiving analog data and a corresponding bit of digital data and for outputting said analog data in accordance with said corresponding bit of said digital data;

a first inverter for inverting said analog data;

a second switching circuit for receiving said inverted analog data from said first inverter and a sign bit corresponding to said digital data and for outputting said inverted analog data in accordance with said sign bit, said sign bit indicating the sign of said digital data; and a capacitive coupling unit for outputting the multiplication of said analog data and said digital data, said capacitive coupling unit having a plurality of first capacitances and a second capacitance, said first capacitances and said second capacitance all being connected in parallel with each other, each first capacitance receiving a corresponding one of said outputs of said first switching circuits, said second capacitance receiving said output of said second switching circuit, each first capacitance having a capacity which is based upon a preselected weight to be given to said corresponding bit of said digital data, and said second capacitance having a capacity which is preselected so as to be double the highest weight given to said bits of said digital data.

* * * * *